US005454335A

United States Patent [19]

Burt et al.

[11] Patent Number: 5,454,335

[45] Date of Patent: Oct. 3, 1995

[54] APPARATUS FOR JOINING FRONT AND REAR FABRIC PANELS

[75] Inventors: Donald E. Burt, Danvers; Steve Lewalski, Melrose; Kevin Keen, Medford, all of Mass.

[73] Assignee: Design Technology Corporation, Billerica, Mass.

[21] Appl. No.: 184,006

[22] Filed: Jan. 19, 1994

[51] Int. Cl.[6] ..... D05B 3/00

[52] U.S. Cl. ..... 112/470.12; 112/63; 112/475.07; 112/475.09; 112/475.03

[58] Field of Search ..... 112/121.14, 121.15, 112/63, 2, 10, 262.1, 262.3

[56] References Cited

U.S. PATENT DOCUMENTS 4,815,405 3/1989 Young, Jr. ..... 112/121.14

5,163,376 11/1992 Frye ..... 112/121.14 X

*Primary Examiner*—Clifford D. Crowder
*Assistant Examiner*—Paul C. Lewis
*Attorney, Agent, or Firm*—Rhodes, Coats & Bennett

[57] ABSTRACT

An apparatus for sewing two fabric panels together along the edges thereof. The apparatus includes a combining fixture for holding the panels such that the edges to be joined hang freely in the combining fixture. A staging mechanism engages the edges of the panels to be joined and disposes the edges in overlapping relationship with one another. A sewing apparatus is insertable into the combining fixture for sewing the edges of the panels together while the panels are held in the combining fixture. Finally, the apparatus includes means for movably mounting the sewing apparatus for reciprocal movement between a retracted position and an extended position with respect to the combining fixture.

27 Claims, 14 Drawing Sheets

APPARATUS FOR JOINING FRONT AND REAR FABRIC PANELS

BACKGROUND OF THE INVENTION (1) Field of the Invention

The present invention relates generally to automated manufacturing systems and, more particularly, to an apparatus for joining front and rear fabric panels for manufacturing a men's brief or the like.

(2) Description of the Prior Art

The manufacture of textile clothing articles such as briefs, tee-shirts and outer garments has resisted automation. This is due largely because of the difficulty in accurately positioning so called "soft" materials. For example, the knitted material commonly used in briefs and tee-shirts may wrinkle, stick to one another and stretch significantly when handled.

One technique which has been somewhat successful has been the introduction of fiber optic edge detectors. 20 Such detectors, when attached to a sewing machine and guide means can allow some automation of common sewing operations such as binding an edge of a precut fabric piece. However, such operations still require the use of a skilled operator to feed the fabric piece to the sewing machine and usually carry out only one sewing operation at a time.

Thus, there remains a need for an apparatus for joining front and rear fabric panels for manufacturing a men's brief or the like which can be carried out completely automatically without the need for a skilled operator.

SUMMARY OF THE INVENTION

The present invention is directed to an apparatus for sewing two fabric panels together along the edges thereof which includes a combining fixture for holding the panels such that the edges to be joined hang freely in the combining fixture. A staging mechanism engages the edges of the panels to be joined and disposes the edges in overlapping relationship with one another. A sewing apparatus is insertable into the combining fixture for sewing the edges of the panels together while the panels are held in the combining fixture. Finally, the apparatus includes means for movably mounting the sewing apparatus for reciprocal movement between a retracted position and an extended position with respect to the combining fixture.

In the preferred embodiment, the staging mechanism includes a pair of lifter blades for insertion beneath the panels to be joined. A pair of stationary blades are disposed above the panels to be joined when the lifter blades are inserted beneath the panels generally parallel to the lifter blades. The staging mechanism also includes means for raising the lifter blade to lift the edges of the panels and to capture the edges of the panels between respective pairs of stationary blades and lifter blades. Finally, a pair of wiper blades are disposed adjacent respective stationary blades and moveable in a generally horizontal plane for stripping the edges of the panels to be joined from between the stationary blades and lifter blades and laying the edges of the panels generally horizontally such that the edges of the panels overlap one another.

Accordingly, one aspect of the present invention is to provide an apparatus for sewing two fabric panels together along the edges thereof. The apparatus includes: (a) a combining fixture for holding the panels such that the edges to be joined hang freely in the combining fixture; (b) a staging mechanism for engaging the edges of the panels to be joined and disposing the edges in overlapping relationship with one another; and (c) a sewing apparatus insertable into the combining fixture for sewing the edges of the panels together while the panels are held in the combining fixture.

Another aspect of the present invention is to provide a staging mechanism for engaging the edges of two panels to be joined and disposing the edges in overlapping relationship with one another in an apparatus for sewing the edges of the two panels together. The staging mechanism includes: (a) a pair of lifter blades for insertion beneath the panels to be joined; (b) a pair of stationary blades disposed above the panels to be joined when the lifter blades are inserted beneath the panels, wherein the stationary blades and the lifter blades are disposed in generally parallel planes; (c) means for raising the lifter blade to lift the edges of the panels and to capture the edges of the panels between respective pairs of stationary blades and lifter blades; and (d) a pair of wiper blades disposed adjacent respective stationary blades and moveable in a generally horizontal plane for stripping the edges of the panels to be joined from between the stationary blades and lifter blades and laying the edges of the panels generally horizontally such that the edges of the panels overlap one another.

Still another aspect of the present invention is to provide an apparatus for sewing two fabric panels together along the edges thereof. The apparatus includes: (a) a combining fixture for holding the panels such that the edges to be joined hang freely in the combining fixture; and (b) a staging mechanism for engaging the edges of the panels to be joined and disposing the edges in overlapping relationship with one another. The staging mechanism includes: (i) a pair of lifter blades for insertion beneath the panels to be joined; (ii) a pair of stationary blades disposed above the panels to be joined when the lifter blades are inserted beneath the panels, wherein the stationary blades and the lifter blades are disposed in generally parallel planes; (iii) means for raising the lifter blade to lift the edges of the panels and to capture the edges of the panels between respective pairs of stationary blades and lifter blades; and (iv) a pair of wiper blades disposed adjacent respective stationary blades and moveable in a generally horizontal plane for stripping the edges of the panels to be joined from between the stationary blades and lifter blades and laying the edges of the panels generally horizontally such that the edges of the panels overlap one another; The apparatus further includes: (c) a sewing apparatus insertable into the combining fixture for sewing the edges of the panels together while the panels are held in the combining fixture; and (d) means for movably mounting the sewing apparatus for reciprocal movement between a retracted position and an extended position with respect to the combining fixture.

These and other aspects of the present invention will become apparent to those skilled in the art after a reading of the following description of the preferred embodiment when considered with the drawings.

DESCRIPTION OF THE PREFERRED EMBODIMENTS

Figure 1A:
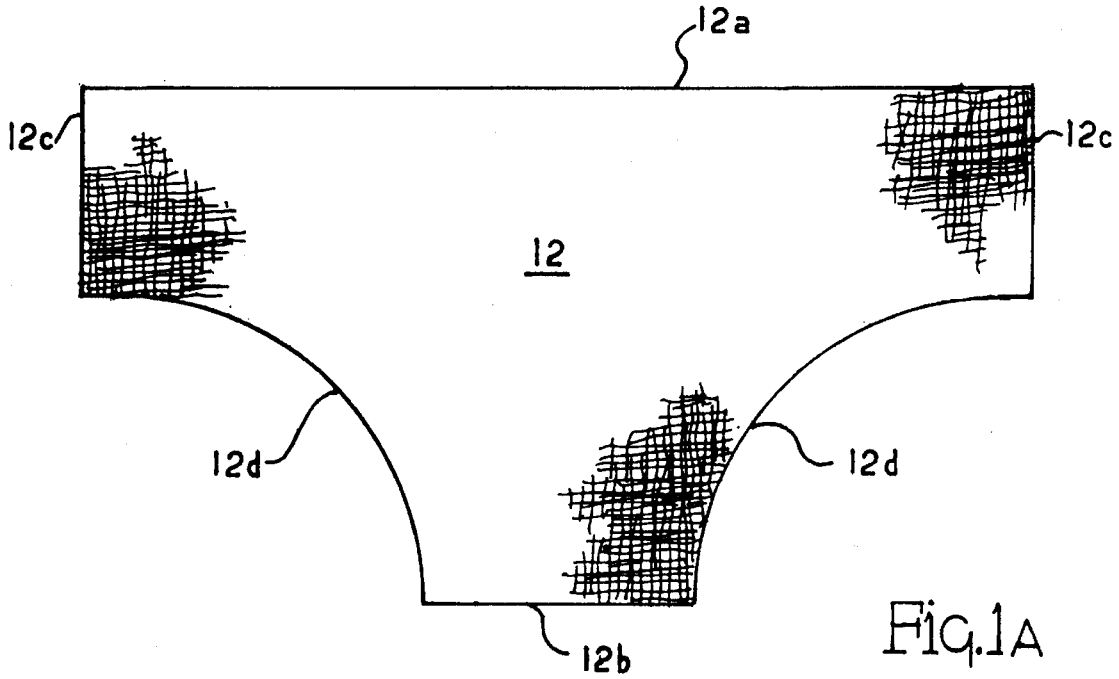
FIG. 1A is a plan view of a back panel.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Figure 1B:
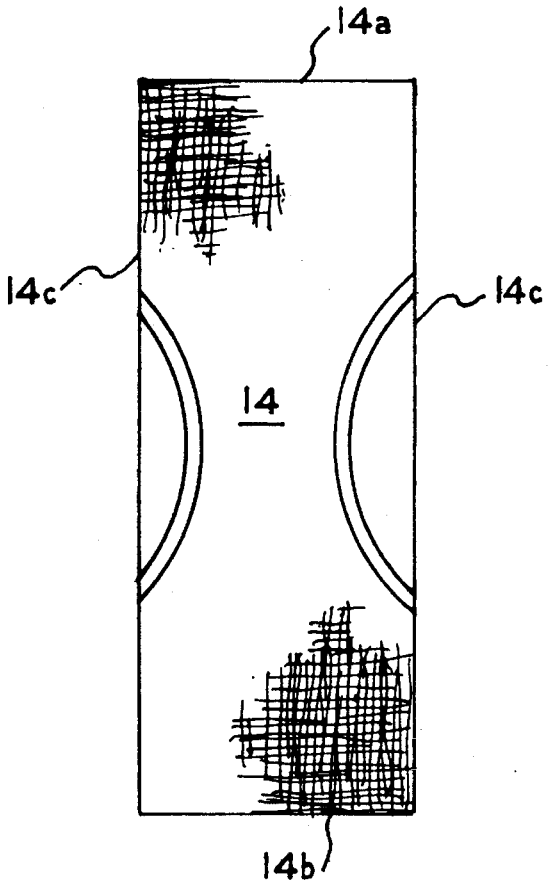
FIG. 1B is a plan view of a front panel.
Figure 1C:
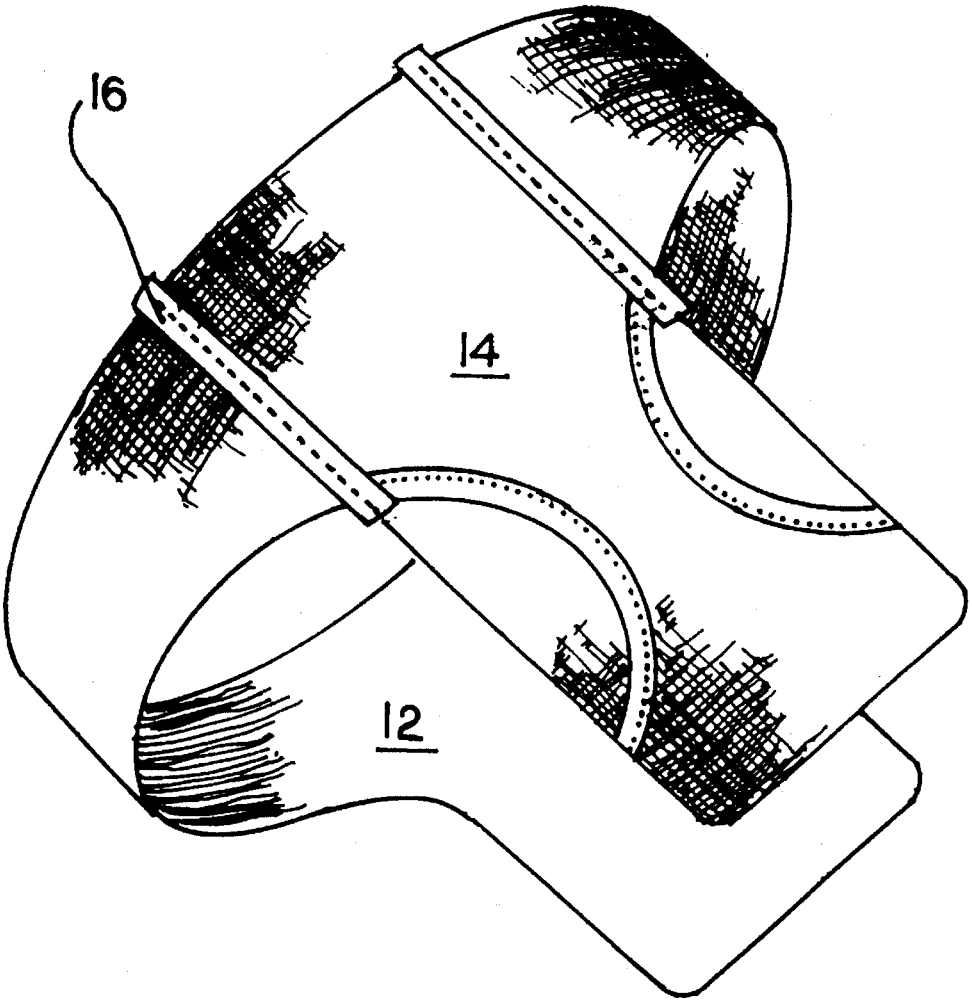
FIG. 1C is a perspective view showing the back panel and front panel joined.
Figure 2:
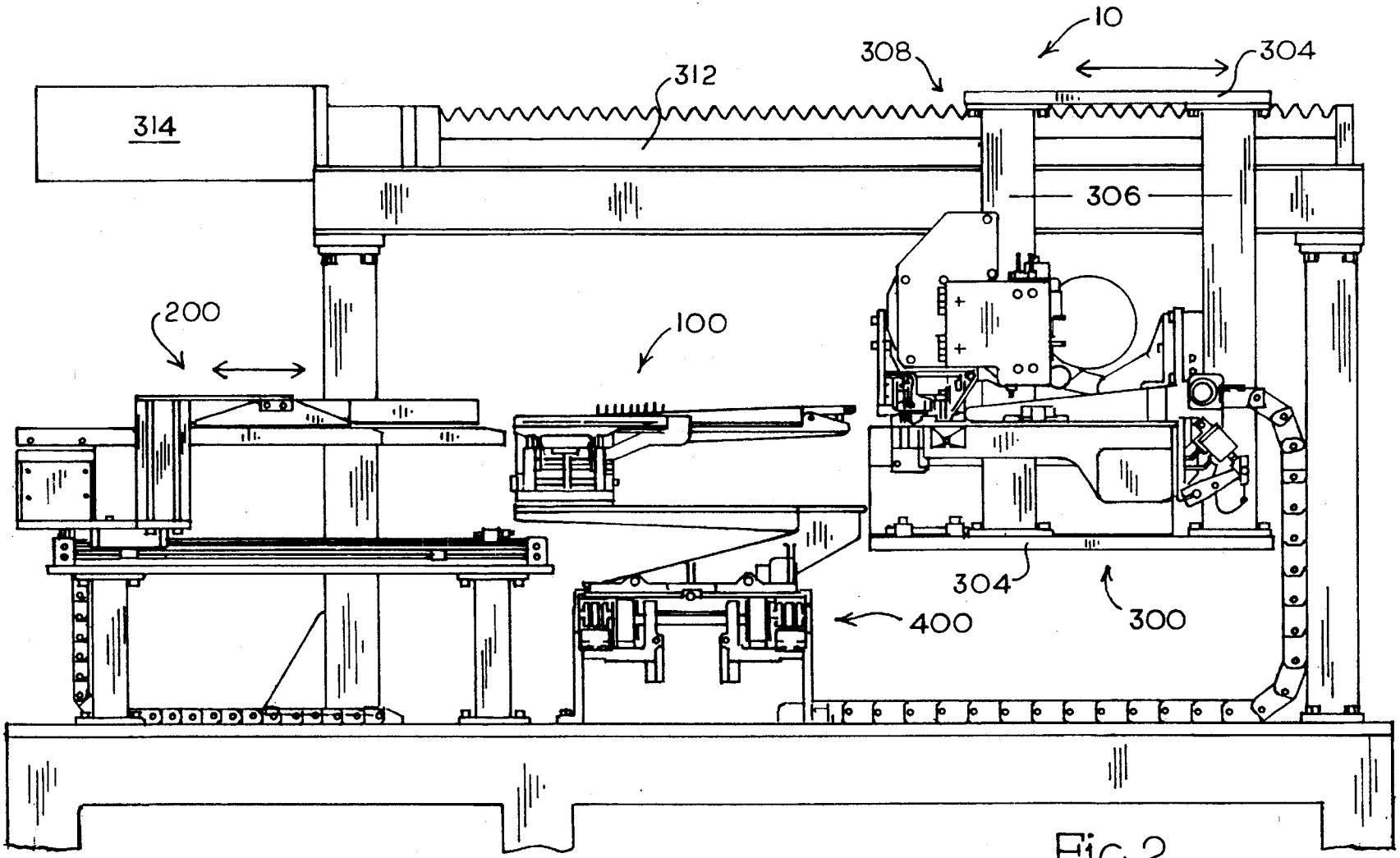
FIG. 2 is a side elevation view of a seam panel machine constructed according to the present invention.

Referring now to the drawings in general and FIG. 1 in particular, it will be understood that the illustrations are for the purpose of describing a preferred embodiment of the invention and are not intended to limit the invention thereto. As best seen in FIG. 2, a seam panel machine constructed according to the present invention, generally designated 10, is shown. The seam panel machine 10 comprises a combining fixture 100 for holding the panels which are being joined, a staging device 200 for engaging and positioning the edges of the panels to be joined, and a sewing apparatus 300 for sewing the edges of the panels together. The combining fixture is transported by a conveyor indicated generally at 400. The conveyor 400 links the seam panel machine 10 with other machines in a production line.

The seam panel machine 10 is designed to sew together two fabric panels. More particularly, the seam panel machine 10 of the present invention is designed to sew the back panel 12 and front panel 14 of a pair of men's briefs together. The back panel 12 and front panel 14 are shown respectively in FIGS. 1A and 1B. The back panel includes a top edge 12*a*, a bottom edge or crotch end 12*b*, side edges 12*c* and leg cuts 12*d*. The front panel 14 has a generally rectangular configuration and includes a top edge 14*a*, a bottom edge or crotch end 14*b*, and two side edges 14*c*. The front panel 14 consists of two plys. Each ply of the front panel 14 includes an arcuate fly cut. The back panel 12 and front panel 14 are sewn together as shown in FIG. 1C. The side edges 12*c* of the back panel 12 are joined with respective side edges of the front panel 14. A binding 16 is applied over the seam. The top edge 12*a* of the back panel is flush with the top edge 14*a* of the front panel. The bottom edges 12*b* and 14*b* are eventually sewn together to form the crotch seam. The crotch seaming operation is performed in a separate step. Although the present invention is designed particularly for use in the manufacture of men's underwear, it can also be adapted for use with other types of garments.

The seam panel machine 10 generally includes a combining fixture 100 for holding the back panel 12 and front panel 14 during the combining operation, a staging mechanism for properly positioning the side edges 12*c* and 14*c* of the panels, and a sewing apparatus 300 for sewing the panels together. In an actual production line, two seam panel machines 10 are used to form respectively the right and left seams. The right and left seam panel machines are identical. Only one machine is described herein, it being understood that the second machine is a mirror image of the one described.

Figure 3:
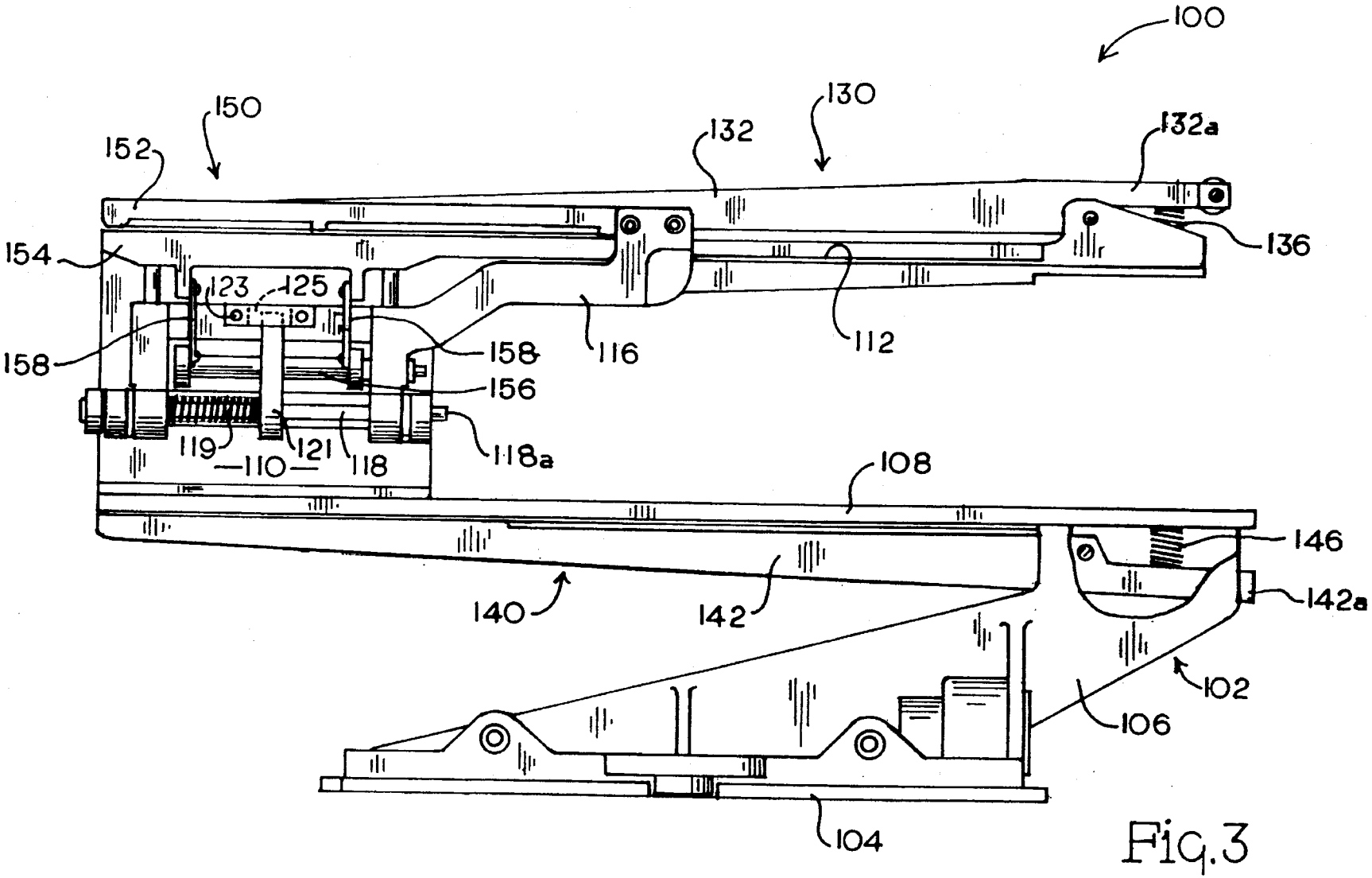
FIG. 3 is a side elevation view of the combining fixture.
Figure 4:
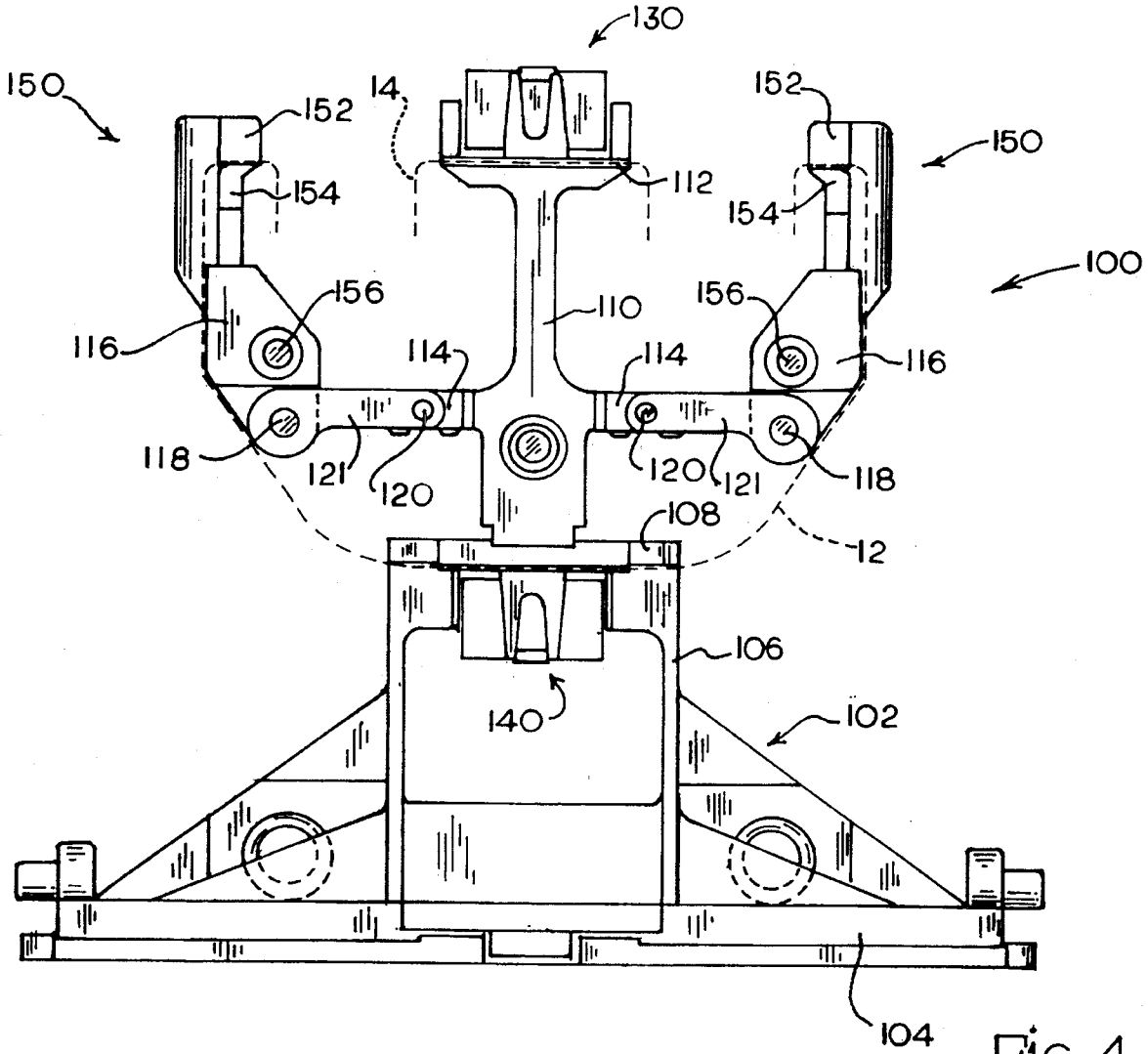
FIG. 4 is an end view of the combining fixture.
Figure 5:
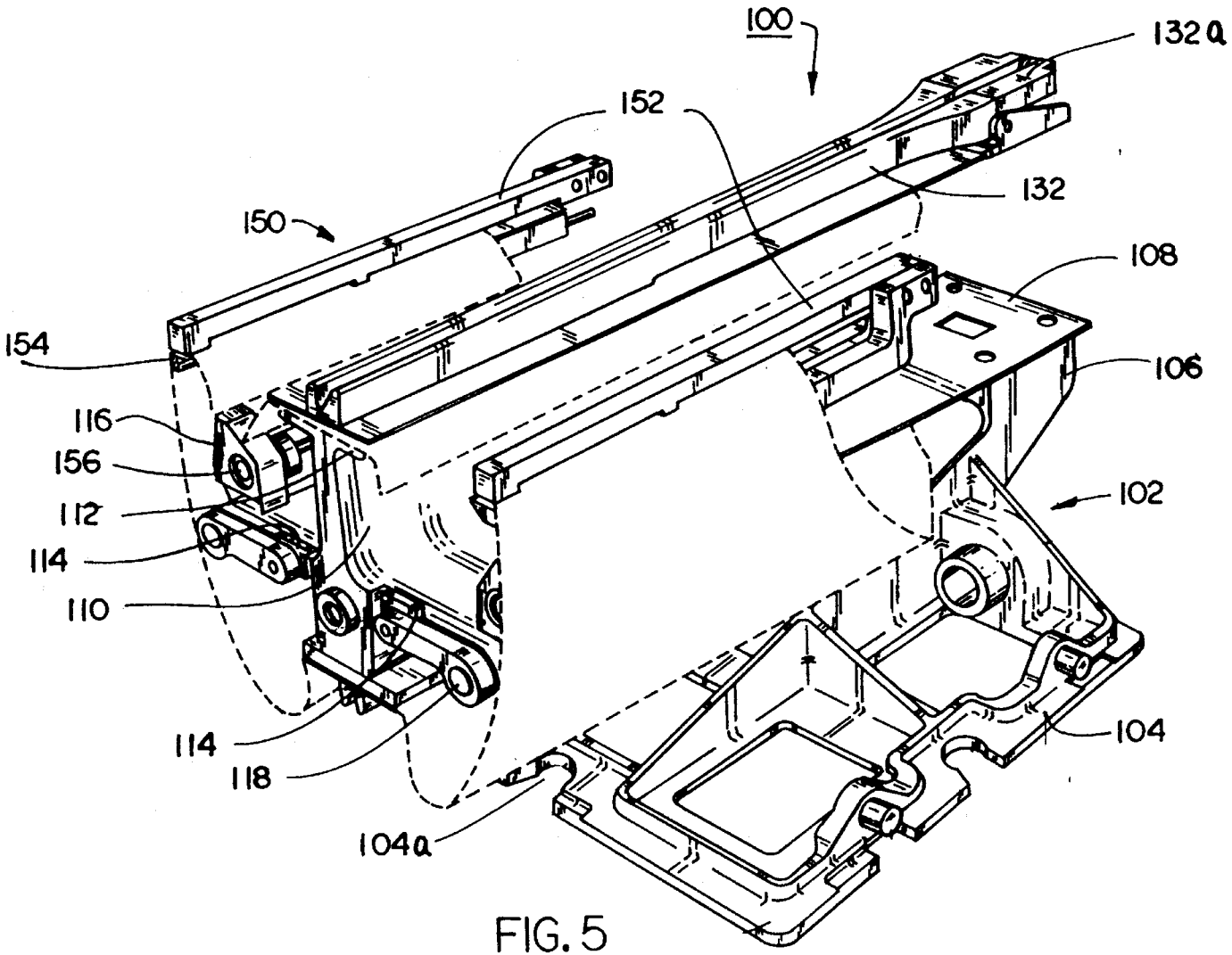
FIG. 5 is a perspective view of the combining fixture.

Referring now to FIGS. 3–5, the combining fixture 100 is shown. The combining fixture includes a support structure 102, a top clamp 130, a bottom clamp 140, and two side clamps 150. The back panel and front panel are held by the combining fixture 100.

The support structure 102 includes a generally flat base 104. The base 104 includes a notch 104*a* which is engaged by a stop pin (not shown) on the conveyor to accurately position the combining fixture during the combining operation. A lower support member 106 extends upwardly from the base 104 and supports an elongated clamping plate 108 from one end thereof. An upper support member 110 is mounted on top of the lower clamping plate 108 at the opposite end. The upper support member 110 includes a flat clamping surface 112. Support arms 114 are rigidly fixed to the upper support member 110 and extend outwardly therefrom. A pivot member 116 is connected to the outer end of each support arm 114 by a pivot rod 118. The pivot member 116 is locked in a raised position by a detent 120 which is mounted on a locking bar 121. The detent 120 engages a recess on the support arm 114. When the end 118*a* of pivot rod 118 is pushed, the detent 120 disengages from the support arm 114. The pivot member 116 can then rotate to a lowered position.

The top clamp 130 includes a clamping arm 132 which is pivotally mounted on top of the upper support member 110. The clamping arm 132 is biased into engagement with the clamping surface 112 by a spring 136. The spring 136 engages an end portion 132*a* of the clamping arm 132. When the end portion 132*a* is pressed against the resistance of the spring 136, the clamping arm 132 is raised off the clamping surface 112. While the clamping arm 132 is in the raised position, the front panel 14 is inserted between the clamping surface 112 and the clamping arm 132 such that the side edges 14*c* of the front panel 14 hang freely from each side of the clamping surface 112 as shown in FIG. 5.

The bottom clamp 140 is similar in construction to the top clamp 130. The bottom clamp 140 includes a clamping arm 142 which is pivotally mounted to the lower support member 106. The clamping arm 142 is biased by a spring 146 into contact with the clamping plate 108. When the end portion 142*a* of the clamping arm is pressed against the resistance of the spring 146, the clamping arm 142*a* is lowered. When the clamping arm 142 is lowered, the back panel is inserted into the bottom clamp 140 such that the center portion of the back panel is held between the clamping arm 142 and clamping plate 108 as shown in FIG. 5.

The end portions of the back panel 12 are held by the side clamps 150. The side clamps 150 include an upper jaw 152 which is fixedly secured to the pivot member 116. A lower jaw 154 is movably mounted to the pivot member 116. The lower jaw 154 is connected to a control rod 156 by linkages 158. When the control rod 156 is rotated, the lower jaw 154 is drawn downward away from the upper jaw 152. The end portions of the back panels 12 are then inserted into respective side clamps 150 such that the edges 12*c* hang downwardly in the combining fixture 100 (see FIG. 5).

When the side clamps 150 are in the raised position, the side clamps 150 are level with the top clamp 130. The side clamps 150 are spaced sufficiently on either side of the top clamp 130 so as to allow the sewing apparatus 300 as hereinafter described to travel between the top clamp 130 and the side clamp 150.

Figure 6:
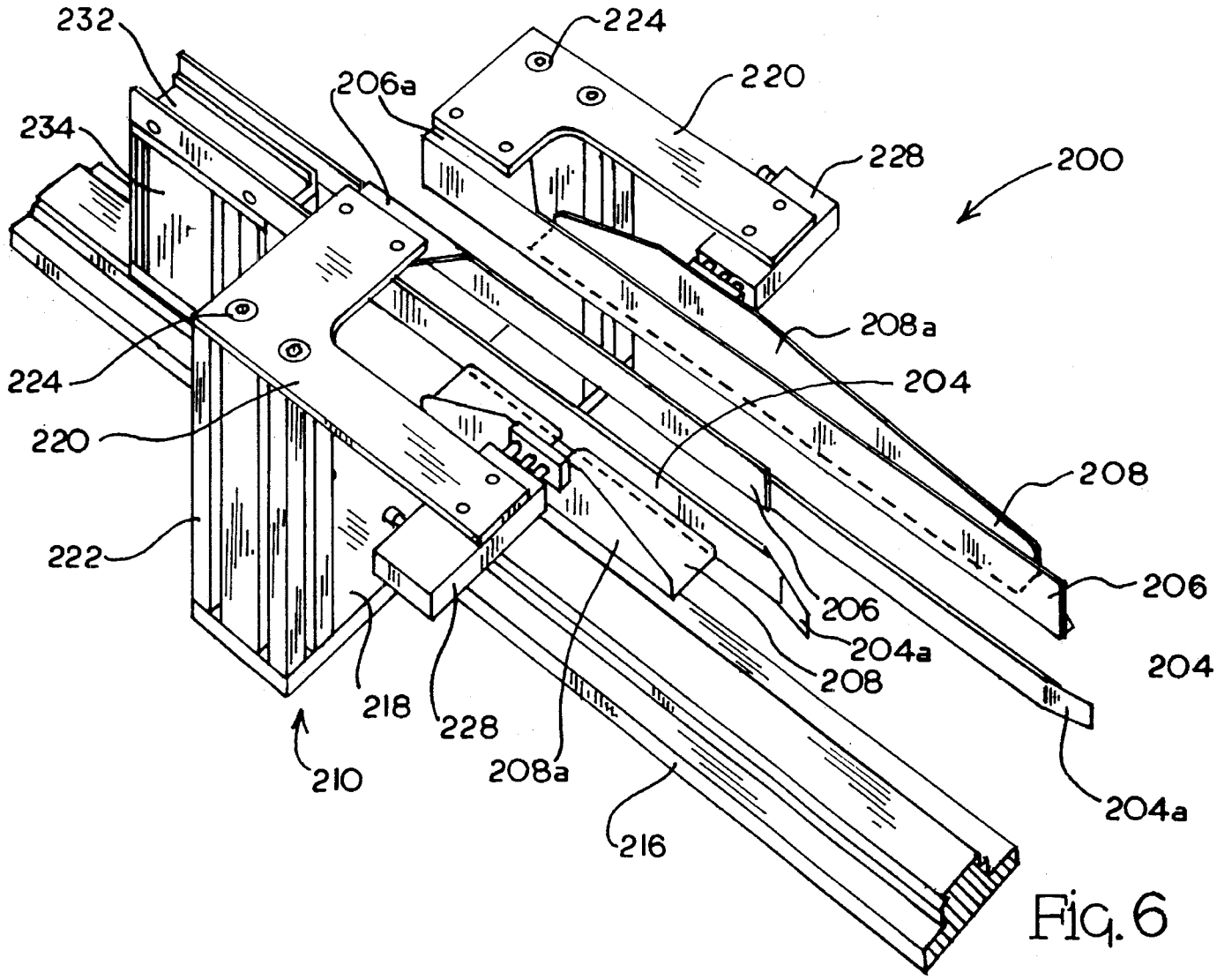
FIG. 6 is a perspective view of the staging mechanism.
Figure 7:
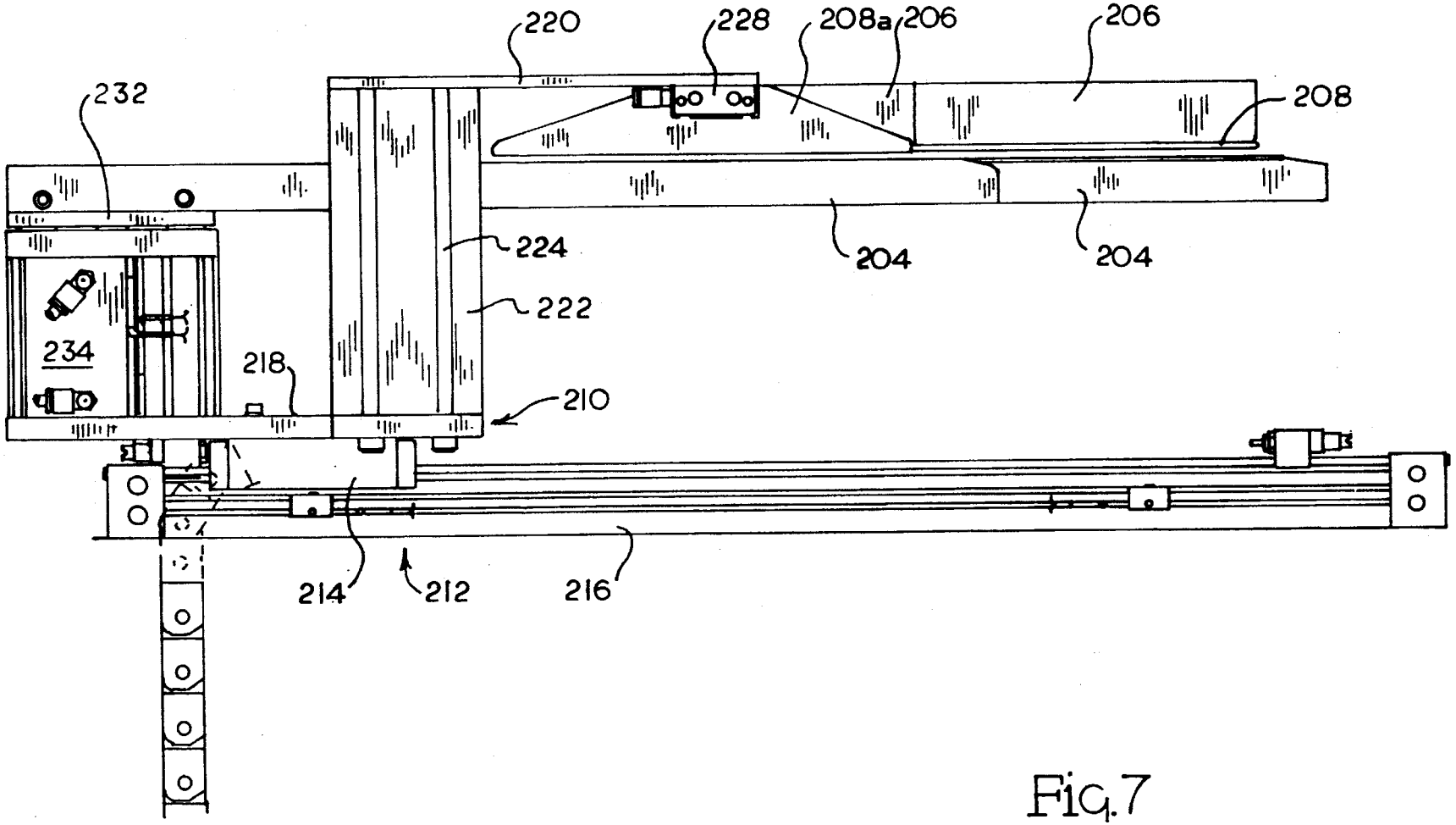
FIG. 7 is a side elevation view of the staging mechanism.

Referring now to FIGS. 6–7, the staging mechanism 200 is shown. The staging mechanism 200 is designed to position the edges of the front and back panels to be joined while the front and back panels are held in the combining fixture 100. The staging mechanism 200 comprises three sets of blades for manipulating the panels to be joined. A pair of lifter blades 204 are inserted underneath the edges of the front and back panels respectively. A pair of stationary blades 206 are mounted above the lifter blades 204. When the lifter blades 204 are raised, the side edges of the front and back panels are held in a vertical position between respective pairs of stationary blades 206 and lifter blades 204. After the sewing apparatus 300 is positioned as will be hereinafter described, a pair of horizontally disposed wiper blades 208 move underneath respective pairs of stationary blades 206 and lifter blades 204 to strip the edges of the panels. As the panels are stripped from between the stationary blades 206 and lifter blades 204, the side edges of the front and back panels are laid in overlapping relationship on the sewing apparatus 300.

The blades 204, 206 and 208 are mounted on a movable support 210. The movable support slides on a linear slide 212 which comprises a slide block 214 and a slide rail 216. The moveable support 210 includes a generally t-shaped bottom plate 218 mounted on the slide block 214 and a pair of L-shaped top plates 220. The top plates 220 are supported in vertically-spaced relationship above the bottom plate 218 by columns 222.

The lifter blades 204 are disposed in a generally vertical plane. One end of each lift blade 204 is attached to a channel member 232. The channel member 232 is connected to a cylinder 234. The cylinder 234 is supported by the bottom plate 218. The cylinder 234 is operable to raise and lower the lifter blades 204 as hereinafter described.

The top plate 220 supports the stationary blades 206. The stationary blades 206 are disposed in a generally vertical plane parallel to the plane of the lifter blades 204. The stationary blades 206 include a flange **206*a* at one end thereof for securing the stationary blades 206 to respective top plates 220**.

The wiper blades 208 are disposed in a generally horizontal plane slightly below the bottom edge of the stationary blades 206. The wiper blades 208 include a flange **208*a* which is connected to a cylinder 228. The cylinder 228 is supported by the top plate 220. The cylinder 228 moves the wiper blade 208 in a direction generally perpendicular to the stationary blades 206 and lifter blades 204** as will be described in more detail below.

Figure 12A:
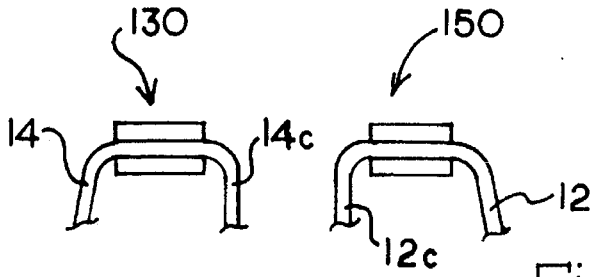
FIGS. 12A–12E are schematic diagrams illustrating the operation of the staging mechanism.
Figure 12B:
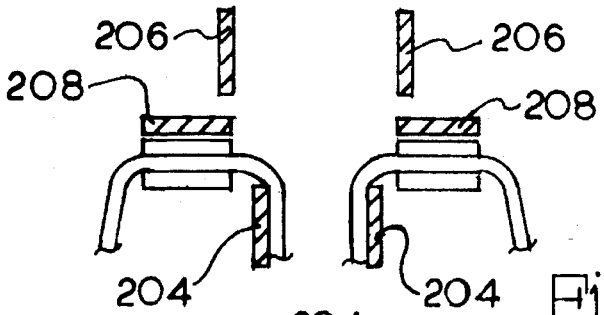
Figure 12C:
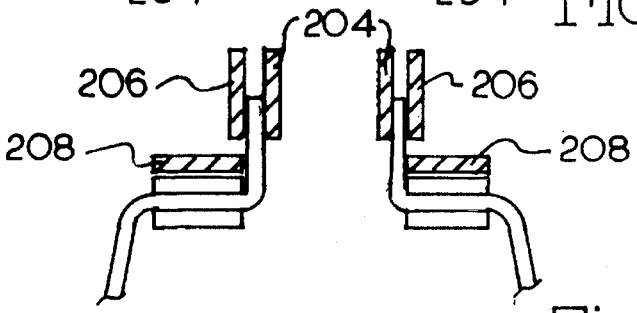
Figure 12D:
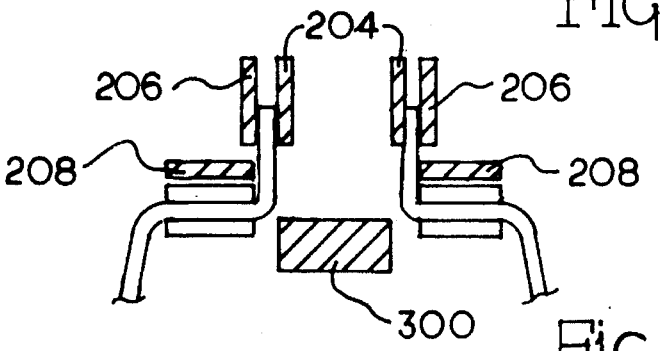
Figure 12E:
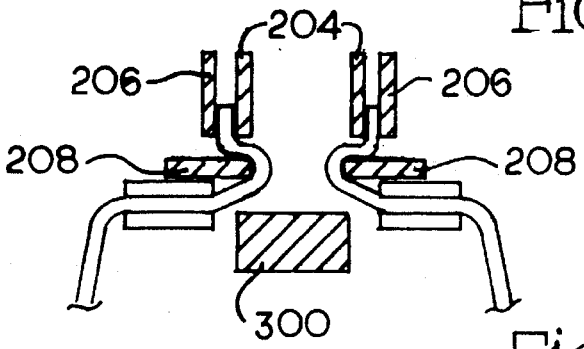

The operation of the staging mechanism 200 is shown schematically in FIGS. 12A–12E. FIGS. 12A is a schematic illustration of the combining fixture 100 showing the top clamp 130 and one side clamp 150. The top clamp 130 holds the front panel 14 with the side edges **14*c* hanging downwardly. The side clamp 150 holds the back panel 12 with one of the side edges 12*c* hanging downwardly. When the combining fixture 100 moves into position, a programmable controller actuates the linear slide 212 to move the staging mechanism 200 forward. The lifter blades 204 start in a lowered position and the wiper blades 208 start in a retracted position as shown in FIG. 12A. As the staging mechanism 200 moves forward, the lifter blades 204 are inserted beneath the edges 12*c* and 14*c* of the respective panels as shown in FIG. 12B. After the lifter blades 204 are inserted beneath the panels, cylinder 234 is actuated to raise the lifter blades 204 such that the lifter blades 204 and stationary blades 206 are disposed in parallel relationship with one another as shown in FIG. 12C. As the lifter blades 204 are raised, the edges 12*c* and 14*c* of the panels are captured between respective pairs of lifter blades 204 and stationary blades 206. While the edges 12*c* and 14*c* of the panels are held in this position, the sewing apparatus 300, described below, is moved into the combining fixture as shown in FIG. 12D. Once the sewing apparatus 300 is positioned, the wiper cylinders 228 are actuated to move the wiper blades 208 inwardly. As the wiper blades 208 move inwardly, the edges 12*c* and 14*c* of the panels are stripped from between the lifter blades 204 and stationary blades 206 and are laid in overlapping relationship on the sewing apparatus 300. The wiper blades 208 are then withdrawn and the staging mechanism 200** is moved back to its starting position.

Figure 8:
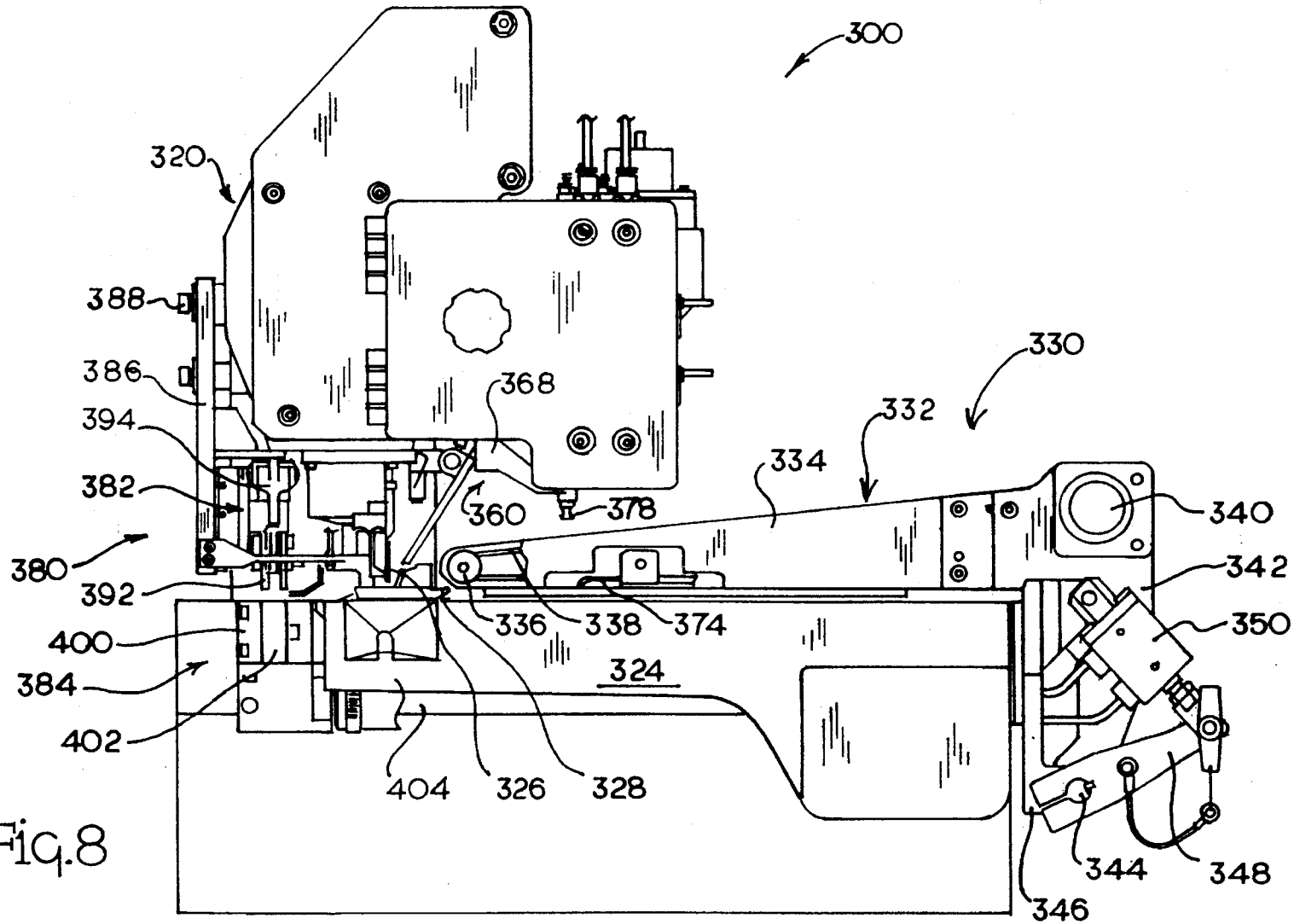
FIG. 8 is a side elevation view of the sewing apparatus.
Figure 9:
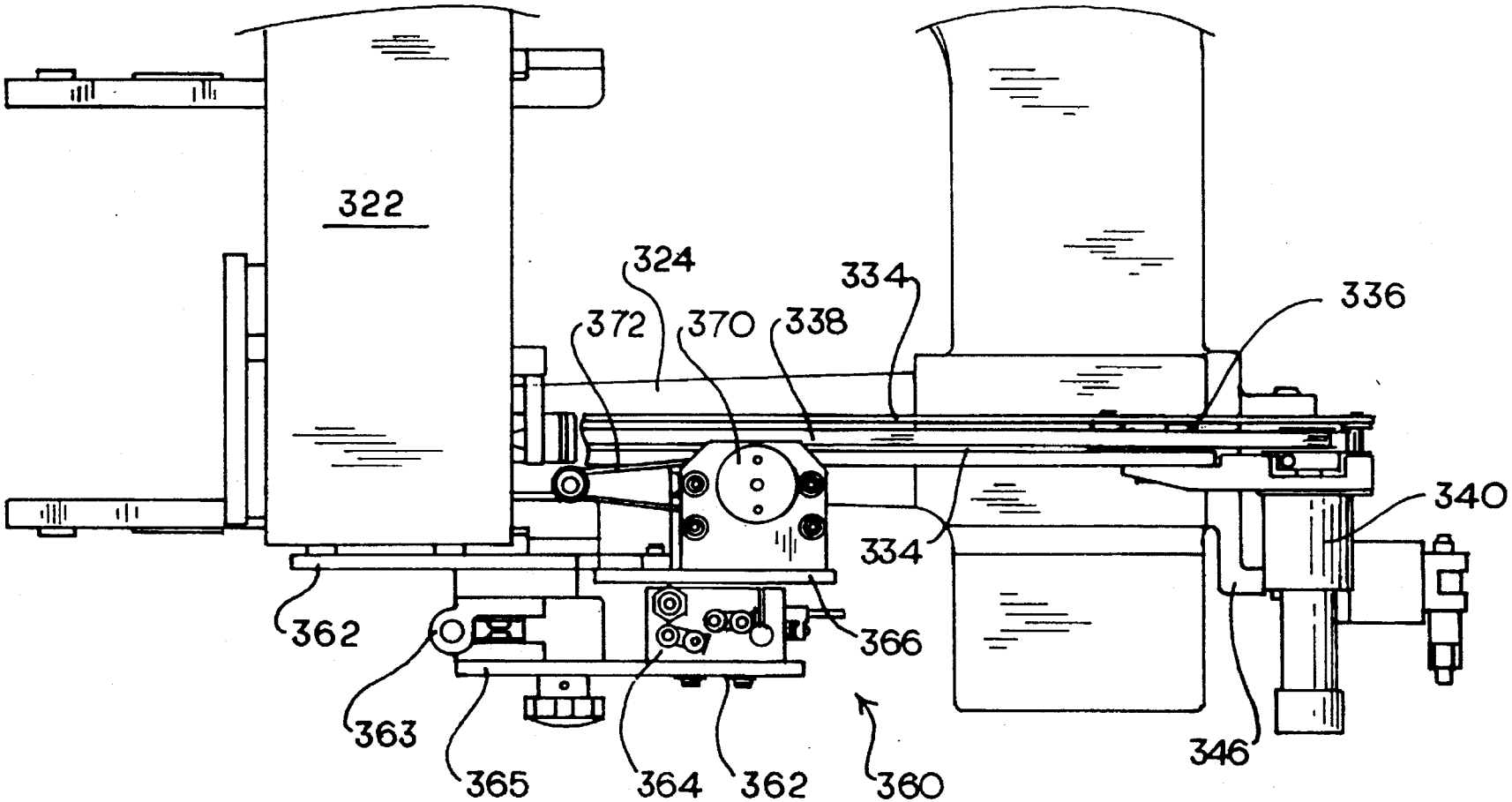
FIG. 9 is a top plan view of the sewing apparatus.

The sewing apparatus 300 for sewing the front and back panels together is shown in FIGS. 8 and 9. The sewing apparatus 300 includes an off-arm sewing machine 320 for sewing the parts, a drive assembly 330 for feeding the panels through the sewing machine 320, a diverter assembly 360 for diverting the front panel 14 during the sewing operation, and a trimmer assembly 380 for severing the binding 16 after the combining operation is completed.

The sewing apparatus comprises a conventional off-arm sewing machine 320. The sewing machine 320 includes a sewing head 322 and a sewing arm 324. The sewing head 322 includes a pair of laterally spaced sewing needles 326 and a presser foot 328 which operate in a conventional fashion.

The sewing apparatus 300 is mounted on a moveable platform 302 for linear movement, as indicated by the arrow in FIG. 2. The moveable platform 302 is suspended from a support plate 304 by frame members 306. The support plate 304 is mounted on a linear slide 308 which includes a slide block 310 and a slide rail 312. A servo-motor 314 provides motor power for the slide block 310.

The drive assembly 330, shown in FIG. 8, includes a drive arm 332 which holds down the panels being sewn and assists in feeding the panels through the sewing head 322. The drive arm 332 includes two side plates 334. A series of pulleys 336 are rotatably mounted between the side plates 334. A feed belt 338 is entrained around the pulleys 336. The feed belt 338 is driven by a servomotor 340 which is mounted on the drive arm 332. The servo-motor 340 is electronically geared to the drive motor (not shown) of the sewing head 322 so that the speed of the feed belt 338 is synchronized with the movement of the sewing head 322 during the sewing operation.

Means are provided for raising and lowering the drive arm 332 with respect to the sewing arm 324. The drive arm 332 includes a lever 342 which is keyed to a shaft 344. The shaft 344 is rotatably mounted in a bracket 346 which is mounted to the sewing arm 324. A crank arm 348 is also keyed to the shaft 344. The end of the crank arm 348 is connected to a cylinder 350. When the cylinder 350 is extended, the drive arm 332 is raised off the sewing arm 324. Conversely, when the cylinder is retracted, the drive arm 332 is lowered down onto the sewing arm 324.

The sewing apparatus 300 is used to sew the back panel 12 and front panel 14 together. The edge of the back panel is shorter than the edge of the front panel to which it is joined. When sewing the edges together, a binding 16 is applied by the sewing apparatus to secure the front and back panels together. After sewing, the binding is trimmed. To prevent the excess portion of the binding 16 from being sewn to the front panel 14, it is necessary to divert the front panel 14 to one side during the sewing operation when the end of the back panel is reached. For this purpose, a diverter assembly 360 is attached to the sewing apparatus.

Figure 10:
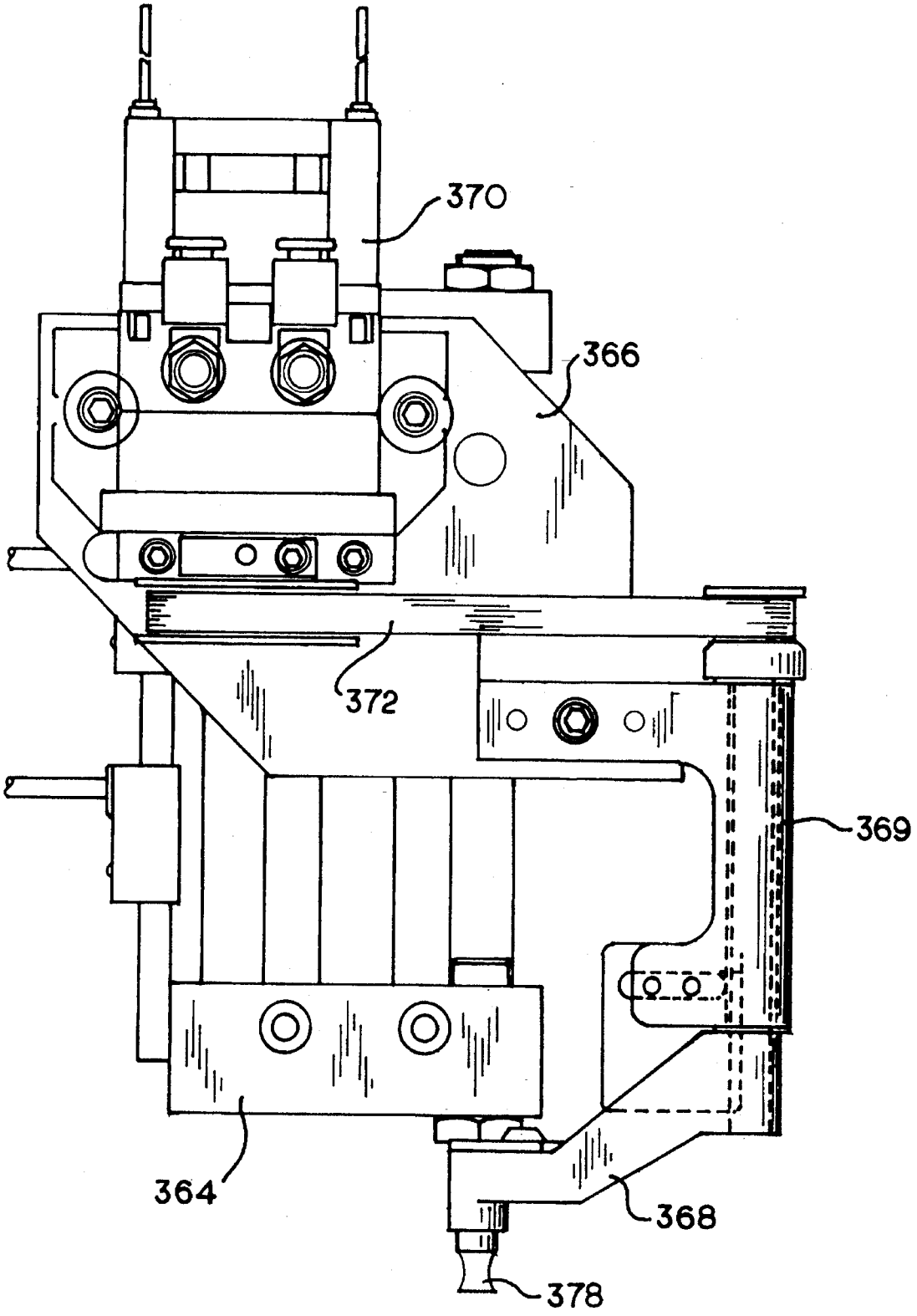
FIG. 10 is an elevation view of the diverter assembly from the inside of the diverter panel.

The diverter assembly 360, shown in FIGS. 9 and 10, includes a support plate 362 which is mounted to the sewing head 322. A diverter panel 365 is connected to the support plate 362 by a hinge 363 to allow access for servicing. A pneumatic slide 364, having a vertically moveable slide plate 366, is mounted to the diverter panel 365. The slide plate 366 will move vertically relative to the sewing arm 324. A diverter arm 368 is mounted to a diverter arm support 369 on the slide plate 366. The diverter arm 368 is rotatable about a vertical axis. The diverter arm 368 is connected to a pneumatic rotary actuator 370 by means of a belt 372. A sensor 374, mounted on the drive arm 332, is provided for sensing the crotch end of the back panel.

Figure 13:
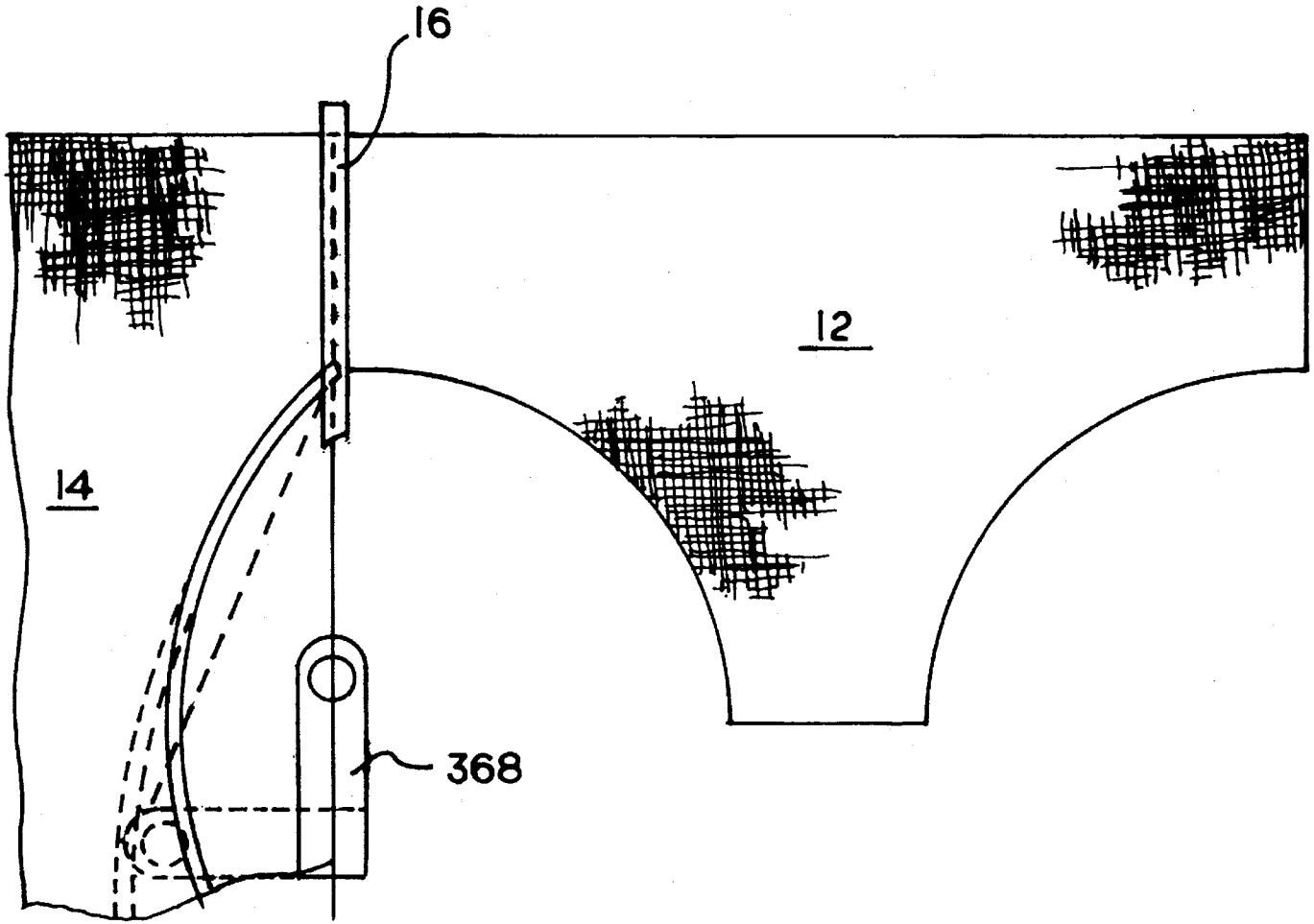
FIG. 13 is a schematic diagram illustrating the operation of the diverter assembly.

The diverter assembly 360 is operated by a programmable controller. When the programmable controller actuates the sewing head to begin sewing, the diverter assembly 360 is in a raised position. When the sensor 374 detects the end of the back panel 12, the vertical slide 304 is actuated by the programmable controller to lower the diverter arm 368 until the diverter foot 378 engages the sewing arm 324. At the same time, the drive arm 332 is raised off the sewing arm 324 to make room for the rotation of the diverter arm 368. After a predetermined time period, the programmable controller actuates the rotary actuator 370 to rotate the diverter arm 368 approximately 130°. As the diverter arm 368 rotates, the diverter foot 378 engages the edge of the front panel 14 and pushes the front panel to one side out of the path of the sewing head 322 as shown schematically in FIG. 13. Thus, the binding is not sewn to the front panel 14 beyond the end of the back panel 12.

Figure 11:
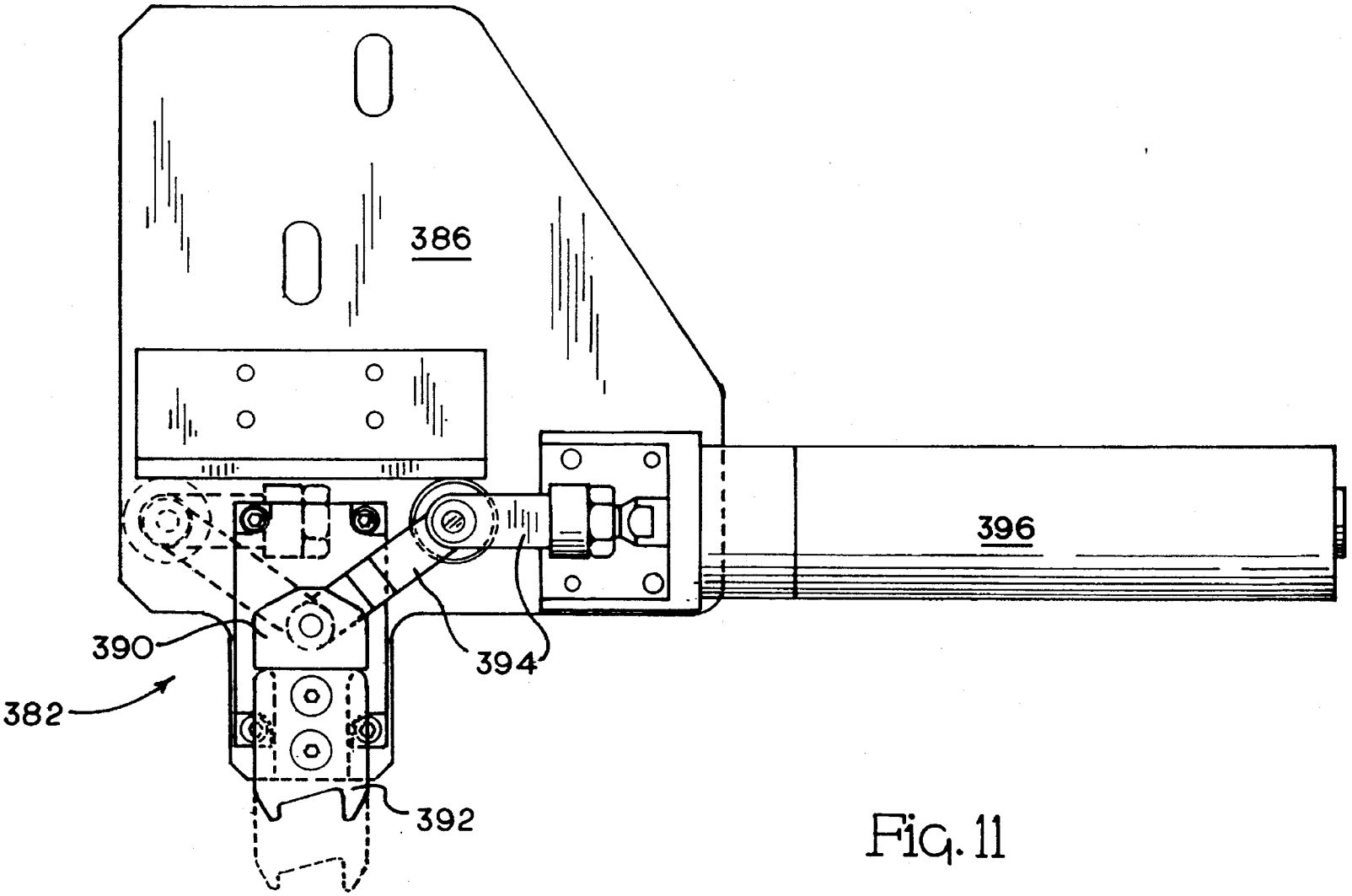
FIG. 11 is an elevation view of the trimmer assembly.

The trimmer assembly 380, shown in FIGS. 8 and 11, includes a cutter assembly 382 which is mounted to the sewing head 322 and an anvil assembly 384 which is mounted to the sewing arm 324. The cutter assembly 382 includes a support plate 386 which is secured by bolts 388 to the sewing head 322. A slide member 390 is mounted for vertical movement to the support plate 386. The slide member 390 carries a pair of shearing blades 392. The slide member 390 is connected by a toggle assembly 394 to a cylinder 396. When cylinder 396 is extended, the toggle assembly 394 pushes the slide member 390 downwardly.

The anvil assembly 384 includes an anvil block 400. The anvil block 400 includes an opening 402 which is aligned with the shearing blades 392 so that the shearing blades 392 extend into the opening 402 to sever the binding. The opening 402 in the anvil block 400 is connected to a vacuum hose 404 for removing the scrap.

The trimmer assembly 380 is actuated by the programmable controller to shear the binding as close as possible to the top edge 12*a* and bottom edge 12*b* of the back panel. For this purpose, a pair of trimming sensors 406, 407 is mounted on a sensor bracket 408 adjacent the shearing blades 392. The sensor bracket 408 is secured to the support plate 386. When the first trimming sensor 406 detects the edge of the back panel 12, the programmable controller actuates cylinder 396 to sever the binding 16 adjacent the top edge 12*a* of the back panel 12. When the second trimming sensor 408 detects the edge of the back panel 12, the cylinder is activated again to sever the binding 16 adjacent the bottom edge 12*b*.

In use, the seam panel machine 10 of the present invention operates as follows. First, the back panel 12 and front panel 14 are loaded into the combining fixture 100. The panels can be manually inserted into the combining fixture 100 or can be inserted by automatic loaders. The combining fixture 100 is then conveyed by means of a conveyor 400 to the seam panel machine 10. Once the combining fixture 100 is in position, the staging mechanism 200 is actuated by a controller to move forwardly into the combining fixture 100. The lifter blades 204 raise the edges of the panels. While the edges of the panels are held in a raised position, the sewing apparatus 300 moves forward into the combining fixture 100. The wiper blades 208 strip the edges of the panels from between respective pairs of lifter blades 204 and stationary blades 206 and lay the edges of the panels in overlapping relationship on the sewing arm 324. The staging mechanism 200 is then withdrawn from the combining fixture 100 and the drive arm 332 of the sewing apparatus is lowered onto the sewing arm 324. The seam panel machine 10 is then ready to begin sewing the edges of the panels together.

The drive motor for the sewing head 322 is actuated by the controller. The motors 314 and 340 for the linear slide 308 and drive arm 332 respectively are electronically geared to the sewing head motor and are also actuated. The feed belt 338 of the drive arm 332 feeds the panels through the sewing head 322 while the sewing head 322 advances to sew the front and back panels together. The first trimming sensor 406 detects the top edge 12*a* of the back panel 12 and actuates the trimmer 380. When the diverter sensor 374 detects the end of the back panels, the diverter arm 368 is lowered to a "ready" position. At the same time, the drive arm 332 is raised. After a predetermined period, the diverter arm 368 is rotated approximately 130° to push the front panel 14 to one side. The sewing head 322 will continue to sew slightly beyond the end of the back panel 14. When the first trimming sensor 406 detects the end of the back panel, the cutting assembly 382 is actuated to sever the binding closely adjacent the bottom edge 12*b* of the back panel 12. The sewing apparatus 300 is then moved back to its original position and the combining fixture 100 is released to be conveyed.

Two seam panel machines 10 are disposed in side-by-side relationship to join respective side edges of the back panels to respective side edges of the front panel 14. When the first seam panel machine 10 has completed its operation, the combining fixture 10 is conveyed to the second seam panel machine 10 and the process is repeated to join the other side edges.

Based on the foregoing, it is apparent that the seam panel machine 10 provides an automated mechanism for sewing the front and back panels of men's underwear together. The seam panel machine 10 of the present invention reduces labor costs associated with the production of men's underwear. Further, the seam panel machine 10 reduces the number of defects as compared to manual sewing operations.

Certain modifications and improvements will occur to those skilled in the art upon a reading of the foregoing description. It should be understood that all such modifications and improvements have been deleted herein for the sake of conciseness and readability but are properly within the scope of the following claims.

We claim:

1. An apparatus for sewing two fabric panels together along the edges thereof, said apparatus comprising:

a combining fixture for holding said panels such that the edges to be joined hang freely in said combining fixture;

(b) a staging mechanism for engaging the edges of said panels to be joined and disposing the edges in overlapping relationship with one another; and (c) a sewing apparatus insertable into said combining fixture for sewing the edges of said panels together while said panels are held in said combining fixture.

2. The apparatus according to claim 1 further including means for movably mounting said sewing apparatus for reciprocal movement between a retracted position with respect to said combining fixture and an extended position.

3. The apparatus according to claim 2 wherein said movable mounting means includes a linear slide and a carriage mounted on said slide for supporting said sewing apparatus.

4. The apparatus according to claim 3 wherein said carriage is suspended below said linear slide.

5. The apparatus according to claim 1 wherein said sewing apparatus includes a sewing arm insertable into said combining fixture when said sewing apparatus is moved from its retracted position to its extended position, and wherein the edges of said panels to be joined are laid in overlapping relationship on said sewing arm by said staging mechanism.

6. The apparatus according to claim 5 wherein said sewing apparatus includes a drive arm pivotally mounted on said sewing arm for holding said panels down against said sewing arm during the sewing operation.

7. The apparatus according to claim 6 wherein said drive arm includes a feed belt for feeding said panels to be joined through said sewing head.

8. The apparatus according to claim 7 wherein said drive arm includes lifting means for raising and lowering said drive arm with respect to said sewing arm.

9. The apparatus according to claim 1 further including a diverter assembly for diverting one of said panels to one side upon the detection of the end of the other of said panels.

10. The apparatus according to claim 9 wherein said diverter assembly includes:

(a) a sensor for detecting the end of a first one of said panels; and (b) a diverter arm which depends downwardly from said sewing apparatus and rotates about a generally vertical axis to move said panel to one side upon the detection of the end of the other panel.

11. The apparatus according to claim 10 wherein said diverter arm includes a diverter foot for engaging the remaining portion of the second panel and diverting it to one side when the diverter arm is rotated.

12. The apparatus according to claim 1 further including a trimmer assembly for trimming a binding applied to said panels by said sewing apparatus.

13. A staging mechanism for engaging the edges of two panels to be joined and disposing said edges in overlapping relationship with one another in an apparatus for sewing the edges of the two panels together, said staging mechanism comprising:

(a) a pair of lifter blades for insertion beneath the panels to be joined;

(b) a pair of stationary blades disposed above the panels to be joined when the lifter blades are inserted beneath said panels, wherein said stationary blades and said lifter blades are disposed in generally parallel planes;

(c) means for raising the lifter blade to lift the edges of said panels and to capture the edges of the panels between respective pairs of stationary blades and lifter blades; and (d) a pair of wiper blades disposed adjacent respective stationary blades and moveable in a generally horizontal plane for stripping the edges of the panels to be joined from between the stationary blades and lifter blades and laying the edges of said panels generally horizontally such that the edges of the panels overlap one another.

14. An apparatus for sewing two fabric panels together along the edges thereof, said apparatus comprising:

(a) a combining fixture for holding said panels such that the edges to be joined hang freely in said combining fixture;

(b) a staging mechanism for engaging the edges of said panels to be joined and disposing the edges in overlapping relationship with one another, said staging mechanism including:

(i) a pair of lifter blades for insertion beneath the panels to be joined;

(ii) a pair of stationary blades disposed above the panels to be joined when the lifter blades are inserted beneath said panels, wherein said stationary blades and said lifter blades are disposed in generally parallel planes;

(iii) means for raising the lifter blade to lift the edges of said panels and to capture the edges of the panels between respective pairs of stationary blades and lifter blades; and (iv) a pair of wiper blades disposed adjacent respective stationary blades and moveable in a generally horizontal plane for stripping the edges of the panels to be joined from between the stationary blades and lifter blades and laying the edges of said panels generally horizontally such that the edges of the panels overlap one another;

(c) a sewing apparatus insertable into said combining fixture for sewing the edges of said panels together while said panels are held in said combining fixture; and (d) means for movably mounting said sewing apparatus for reciprocal movement between a retracted position with respect to said combining fixture and an extended position.

15. The apparatus according to claim 14 wherein said movable mounting means includes a linear slide and a carriage mounted on said slide for supporting said sewing apparatus.

16. The apparatus according to claim 15 wherein said carriage is suspended below said linear slide.

17. The apparatus according to claim 16 wherein said sewing apparatus includes a sewing arm insertable into said combining fixture when said sewing apparatus is moved from its retracted position to its extended position, and wherein the edges of said panels to be joined are laid in overlapping relationship on said sewing arm by said staging mechanism.

18. The apparatus according to claim 17 wherein said sewing apparatus includes a drive arm pivotally mounted on said sewing arm for holding said panels down against said sewing arm during the sewing operation.

19. The apparatus according to claim 18 wherein said drive arm includes a feed belt for feeding said panels to be joined through said sewing head.

20. The apparatus according to claim 19 wherein said drive arm includes lifting means for raising and lowering said drive arm with respect to said sewing arm.

21. The apparatus according to claim 14 further including a diverter assembly for diverting one of said panels to one side upon the detection of the end of the other of said panels.

22. The apparatus according to claim 21 wherein said diverter assembly includes:

(a) a sensor for detecting the end of a first one of said panels; and (b) a diverter arm which depends downwardly from said sewing apparatus and rotates about a generally vertical axis to move said panel to one side upon the detection of the end of the other panel.

23. The apparatus according to claim 22 wherein said diverter arm includes a diverter foot for engaging the remaining portion of the second panel and diverting it to one side when the diverter arm is rotated.

24. The apparatus according to claim 14 further including a trimmer assembly for trimming a binding applied to said panels by said sewing apparatus.

25. A method for sewing two fabric panels together along the edges thereof, said method comprising the steps of:

(a) holding said panels such that the edges to be joined hang freely in a combining fixture;

(b) utilizing a staging mechanism to engage the edges of said panels to be joined and dispose the edges in overlapping relationship with one another; and (c) sewing the edges of said panels together while said panels are held in said combining fixture.

26. A method for engaging the edges of two panels to be joined and disposing said edges in overlapping relationship with one another for sewing the edges of the two panels together, said method comprising the steps of:

(a) inserting a pair of lifter blades beneath the panels to be joined;

(b) disposing a pair of stationary blades above the panels to be joined when the lifter blades are inserted beneath said panels, wherein said stationary blades and said lifter blades are disposed in generally parallel planes;

(c) raising the lifter blade to lift the edges of said panels and to capture the edges of the panels between respective pairs of stationary blades and lifter blades; and (d) moving a pair of wiper blades disposed adjacent respective stationary blades in a generally horizontal plane for stripping the edges of the panels to be joined from between the stationary blades and lifter blades and laying the edges of said panels generally horizontally such that the edges of the panels overlap one another.

27. A method for sewing two fabric panels together along the edges thereof, said method comprising the steps of:

(a) holding said panels such that the edges to be joined hang freely in a combining fixture;

(b) engaging the edges of said panels to be joined and disposing the edges in overlapping relationship with one another in a staging mechanism, said staging mechanism including:

(i) a pair of lifter blades for insertion beneath the panels to be joined;

(ii) a pair of stationary blades disposed above the panels to be joined when the lifter blades are inserted beneath said panels, wherein said stationary blades and said lifter blades are disposed in generally parallel planes;

(iii) means for raising the lifter blade to lift the edges of said panels and to capture the edges of the panels between respective pairs of stationary blades and lifter blades; and (iv) a pair of wiper blades disposed adjacent respective stationary blades and moveable in a generally horizontal plane for stripping the edges of the panels to be joined from between the stationary blades and lifter blades and laying the edges of said panels generally horizontally such that the edges of the panels overlap one another;

(c) sewing the edges of said panels together while said panels are held in said combining fixture; and (d) movably mounting said sewing apparatus for reciprocal movement between a retracted position with respect to said combining fixture and an extended position.

* * * * *